United States Patent [19]

Weber et al.

[11] Patent Number: 4,736,930

[45] Date of Patent: Apr. 12, 1988

[54] CLOSURE APPARATUS FOR A TAP HOLE

[75] Inventors: Ralph Weber, Rio de Janeiro; William Wells, Sao Paulo, both of Brazil

[73] Assignee: Kortec AG, Zug, Switzerland

[21] Appl. No.: 878,954

[22] PCT Filed: Oct. 12, 1985

[86] PCT No.: PCT/EP85/00537

§ 371 Date: Jun. 13, 1986

§ 102(e) Date: Jun. 13, 1986

[87] PCT Pub. No.: WO86/02435

PCT Pub. Date: Apr. 24, 1986

[30] Foreign Application Priority Data

Oct. 16, 1984 [DE] Fed. Rep. of Germany ..... 3437810

[51] Int. Cl.[4] ..... C21C 5/48

[52] U.S. Cl. ..... 266/272; 222/597

[58] Field of Search ..... 266/272, 273, 271, 45, 266/225, 217; 222/597, 601, 602, 603

[56] References Cited

U.S. PATENT DOCUMENTS

| | | | |
|---|---|---|---|
| 3,200,457 | 8/1965 | Wagstaff | 222/597 |
| 3,507,483 | 4/1970 | Resch | 266/273 |
| 3,968,907 | 7/1976 | Nelson et al. | 266/272 |
| 4,097,030 | 6/1978 | Desaar | 266/225 |
| 4,520,861 | 6/1985 | Sobolewski et al. | 222/597 |

FOREIGN PATENT DOCUMENTS

| | | |
|---|---|---|
| 8001659 | 8/1980 | PCT Int'l Appl. . |
| 1581058 | 12/1978 | United Kingdom . |

OTHER PUBLICATIONS

Stahl and Eisen, No. 104, pp. 27–30, Jan. 1980.

*Primary Examiner*—L. Dewayne Rutledge
*Assistant Examiner*—S. Kastler

[57] ABSTRACT

Provided for the tap hole in the bottom of a metallurgical vessel is a closure apparatus comprising a shut-off member which can close off the tap hole from below, and a pipe which is displaceable from above through the molten bath into a lowered blocking position in which it bears against the upper edge of the tap hole. An axially displaceable lance may be disposed in the pipe so that the pipe can be used for burning open the tap hole, by means of oxygen. Filling material which is capable of flow can also be introduced into the tap hole, through the pipe. The closure apparatus makes it possible to carry out a sump mode of operation, without tilting the vessel.

12 Claims, 2 Drawing Sheets

CLOSURE APPARATUS FOR A TAP HOLE

TECHNICAL FIELD

The invention relates to a closure apparatus for a tap hole in the bottom of a metallurgical vessel, in particular a metal smelting furnace, comprising a shut-off member which can close off the tap hole from below and which is protected from direct contact with the molten metal bath by a filling material which is introduced into the tap hole.

BACKGROUND ART

Closure apparatuses of that kind are disclosed for example in the journals RADEX-Rundschau, 1980, issue 3, pages 187 to 196, and Stahl und Eisen 104 (1984), No 1, pages 27 to 30. In those constructions, the shut-off member is in the form of a pivotable flap which in the closed position bears against the tap hole from below and prevents granular refractory material introduced into the tap hole before the furnace is charged from flowing out. During the smelting operation, the filling material prevents direct contact between the shut-off member and the molten bath. For the purposes of tapping the vessel, the flap is pivoted to the side, the filling material drops out and the molten material flows out of the hearth into a tapping truck. If, by virtue of the filling material coming into contact with the molten bath, sintered bridges which prevent the foregoing procedure from being carried out have been formed in the filling material, the tapping operation is started by a brief burn with oxygen. After the molten bath has run out, the closure flap is closed again and the tapping passage is filled with granular refractory material before the next furnace charge is introduced.

If, when tapping off a metallurgical vessel with a closure apparatus of the above-indicated kind, a residual portion of the molten metal and the slag is retained in the vessel in order to improve the smelting or metallurgical process in respect of the next charge (that mode of operation is referred to as the sump process), then it is necessary for the vessel to be designed in such a way that it can be tilted in order to ensure that the closure system is not subjected to wear by the fluid metal or slag. Expensive arrangements are required for that purpose, in vessels of larger sizes.

Austrian patent specification No. 207 053 discloses a bottom closure arrangement for casting ladles and the like, wherein the bottom opening in the vessel can be closed by a plug bar, wherein the tap hole is arranged to be heated, and wherein in addition there is a shut-off member in the form of a pivotable flap or a pivotable plug which is adapted to close the tap hole from below. The plug bar which can be drawn entirely out of the molten bath makes it possible for the pouring jet of liquid material to be regulated or stopped during the operation of pouring out the molten bath. Desirably, the last part of the molten bath is held back by means of the lower shut-off member, and caused to harden in order to form a new sealed plug for the next charge. As soon as that plug has been formed, the lower plate can be pivoted to one side again so that it is not subjected to any thermal or mechanical loading during the smelting process. Heating of the tap hole causes the hardened plug to be liquefied and the pouring operation started. Although that closure apparatus makes it possible to perform the above-mentioned sump process without tilting the vessel, the lower closure member is in this case subjected to the effect of the liquid metal, and in addition a heating means must be provided in the region of the tap hole.

In a closure apparatus of the kind set forth above, wherein the shut-off member which closes off the tap hole from below is protected from direct contact with the molten metal bath, an object of the present invention is to make it possible, without tilting the vessel, to carry out a 'sump process' wherein a residual portion of the molten metal bath and the slag floating on the metal bath are held back in the vessel. The invention further seeks to provide that, by means of the closure apparatus, oxygen can be supplied for opening the tap hole when starting the tapping operation and a filling material for filling the tap hole can be supplied after the tapping operation has been concluded. The invention further seeks to provide that the parts of the closure apparatuses, which are subjected to a thermal loading, can be simply cooled.

DISCLOSURE OF INVENTION

The invention is characterized by a pipe which is displaceable from a lowered blocking position in which it bears against the upper edge of the tap hole, into a raised open position in which it opens the tap hole, and which has a protective layer of refractory material at least in its region of contact with the molten bath.

Besides a shut-off member which can close the tap hole from below, the closure apparatus includes a pipe which dips into the molten metal and which, like a plug bar, can also close off the tap hole from above and can regulate the flow through the tap hole. By virtue of the member being in the form of a pipe, it is also possible, when the arrangement is in the lowered blocking position in which the pipe bears against the upper edge of the tap hole and thus the lower discharge opening of the pipe communicates with the tap hole, for oxygen to be injected through the pipe for the purposes of opening and cleaning the tape hole, while, after the tap hole has been closed from below by the underneath shut-off member, the tap hole can be filled with granular filling material through the pipe. As, when the pipe bears against the upper edge of the tap hole, which is preferably formed as a suitable seat for the lower edge of the pipe, the molten metal is prevented from gaining access to the tap hole, the above-indicated steps of injecting oxygen and introducing granular filling material through the pipe can also be carried out when the pipe is immersed into the molten bath so that this makes it possible to carry out a 'sump mode of operation', without the vessel having to be tilted. It will be appreciated that, when the pipe is introduced into the molten bath, a gas must be injected to ensure that the molten bath cannot penetrate into the pipe through the lower opening thereof. The injected gas be used at the same time for cooling the pipe.

Preferably, the arrangement includes a lance which is axially displaceable in the pipe, for injecting the gas, wherein the lower end of the lance can be displaced downwardly beyond the bottom opening of the pipe.

BRIEF DESCRIPTION OF DRAWINGS

The invention will now be described in greater detail by means of an embodiment with reference to three Figures of the accompanying drawings in which.

MODES FOR CARRYING OUT THE INVENTION

Figure 1:
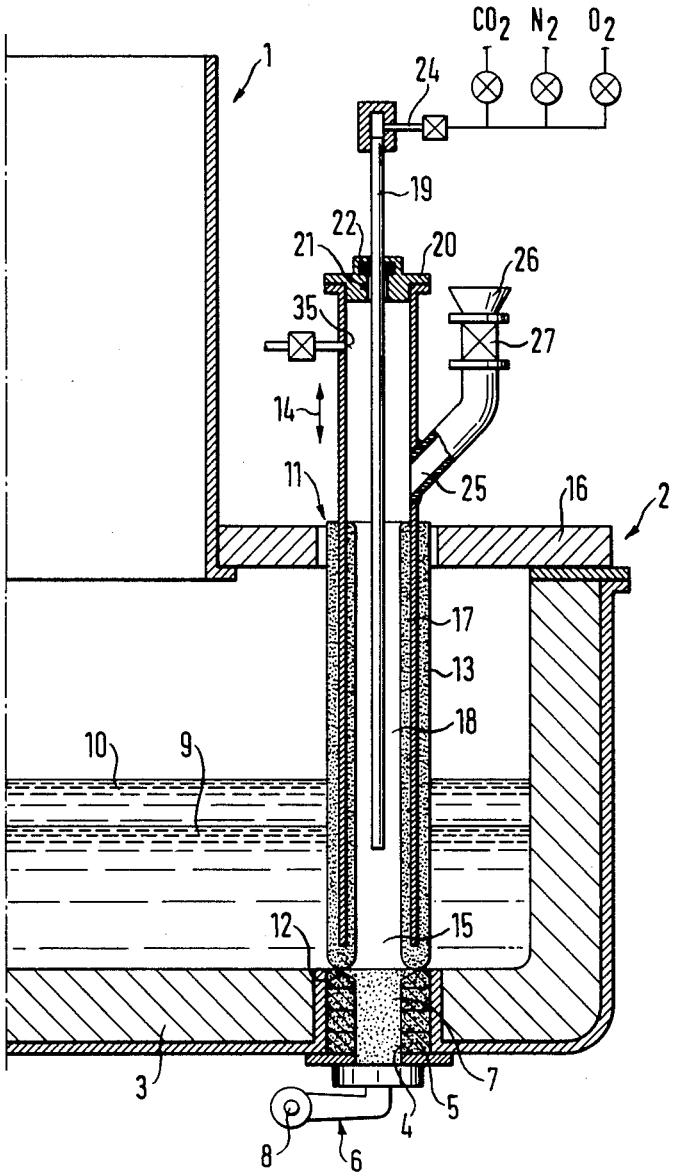
FIG. 1 is a diagrammatic view in vertical section of the part, which is essential for the invention, of a metallurgical vessel wherein the closure apparatus is arranged in a portion of the vessel which projects therefrom in the manner of a bay window.

FIG. 1 is a view in longitudinal section of a part of a metallurgical vessel 1 which has a portion 2 that projects from the body of the vessel in the manner of a bay window configuration. The metallurgical vessel 1 may be a smelting furnace, a holding or annealing furnace, a ladle and the like. Disposed in the bottom 3 of the outwardly projecting portion 2 of the vessel, which is approximately at the same level or slightly lower than the remainder of the bottom of the vessel, is a tap hole 4 which is formed by apertured bricks 5 fitted into the bottom 3. The tap hole 4 can be closed off from below by a shut-off member 6 which is in the form of a pivotable flap in the illustrated embodiment. In the closure position as illustrated, the shut-off member 6 closes off the tap hole 4 from below so that a filling mass 7 of refractory material, which is capable of flow and which is introduced into the tap hole, cannot fall out. In the opening position of the assembly, in which the flap is pivoted downwardly about the axis 8, the flap 6 completely opens the path for the jet of molten metal that issues from the tap hole. The shut-off member 6 may also be in the form of a pivotable plug or stopper, a slider member, or a plate which can be pivoted away laterally. It is protected from direct contact with a molten metal bath 9 which is above the tap hole, by the filling material indicated at 7. In the illustrated embodiment, the molten metal bath 9 is a residual molten bath which remains in the vessel in order to improve the conditions for smelting of the next charge. A layer of slag 10 floats on the molten metal bath 9.

Besides the lower shut-off member 6, the closure apparatus also includes a tube or pipe which can be displaced from a lowered blocking position in which it bears against the upper edge 12 of the tap hole 4, as shown in FIG. 1, into a raised open position (not shown) in which the pipe 11 opens the tap hole 4. At least in its region in which it comes into contact with the molten bath, the pipe 11 has a protective layer 13 of refractory material. The displaceability of the pipe 11 is indicated in FIG. 1 by a double-headed arrow 14, and a suitable mechanism for displacing the pipe 11 will be described with reference to FIGS. 2 and 3. The axis of the pipe 11 along which the pipe is displaceable as indicated by the double-headed arrow 14 substantially coincides with the axis of the tap hole 4, in the illustrated embodiment. However, it would also be possible for the axis of the pipe 11 and the axis of the tap hole 4 to be slightly shifted relative to each other in parallel relationship, or to be slightly inclined relative to each other. The important consideration is that the seat of the lower end of the pipe on the edge 12 of the tap hole 4 is fairly fluid-tight and in the lowered blocking position, the lower discharge opening 15 of the pipe 11 communicates with the tap hole 4. The pipe 11 is guided through a cover member 16 which forms a closure for the top of the projecting portion 2 of the metallurgical vessel. The pipe 11 preferably includes a metal pipe 17 which, as illustrated, is protected on the outside by the protective layer 13, over the entire region of the pipe 17 which dips into the metallurgical vessel 1. The protective layer 13 must also cover the lower end, that is to say, it must be extended around the lower edge of the metal pipe 17. The metal pipe 17 may be in the form of a double-wall pipe with cooling passages or ducts.

As will be described hereinafter, the pipe 11 is used for introducing gaseous agents and a filling material which is capable of flow. Therefore, in the region outside the vessel, the pipe 11 must have suitable connections for the above-mentioned gaseous agents, as well as sealing means and valves, in order to ensure that various gaseous agents can be selectively passed through the pipe 11 into the interior of the vessel or furnace or into the tap hole 4. In the illustrated embodiment, for the purposes of introducing gaseous agents, a lance 19 is axially displaceably disposed within the pipe 11, forming an annular passage 18. The lance 19 which consists of a steel pipe is passed through a closure cover member 20 which is fitted on to the pipe 11, the closure cover member 20 having a through opening 21 which is provided with a seal 22. A guide means for the lance 19 may also be disposed within the pipe 11. However, the guide means should not substantially restrict the flow of granular material through the annular passage 18. A gas connection 24 can be pushed on to the top of the lance 19 which is consumed in operation of the apparatus. Moreover, the lance 19 may also be in the form of a multiple pipe in order to permit the simultaneous introduction of different agents and also for example to permit it to be used as a burner. In the illustrated embodiment however, it only comprises one pipe. The gas connection 24 is connected by way of valves to a source for inert gas such as nitrogen or for carbon dioxide or to an oxygen source.

Outside the vessel 1, the pipe 11 also includes an opening 25 which communicates with the annular space 18. With that arrangement, by way of a hopper 26 and a blocking and metering device 27, predetermined amounts of filling material 7 can be introduced into the annular passage 18. The filling material 7 passes downwardly through the annular passage 18 and the bottom discharge opening 15 of the pipe 11, into the tap hole 4.

Finally, the apparatus also includes a closable opening 35 which communicates with the annular passage 18, for introducing gaseous agents.

Figure 2:
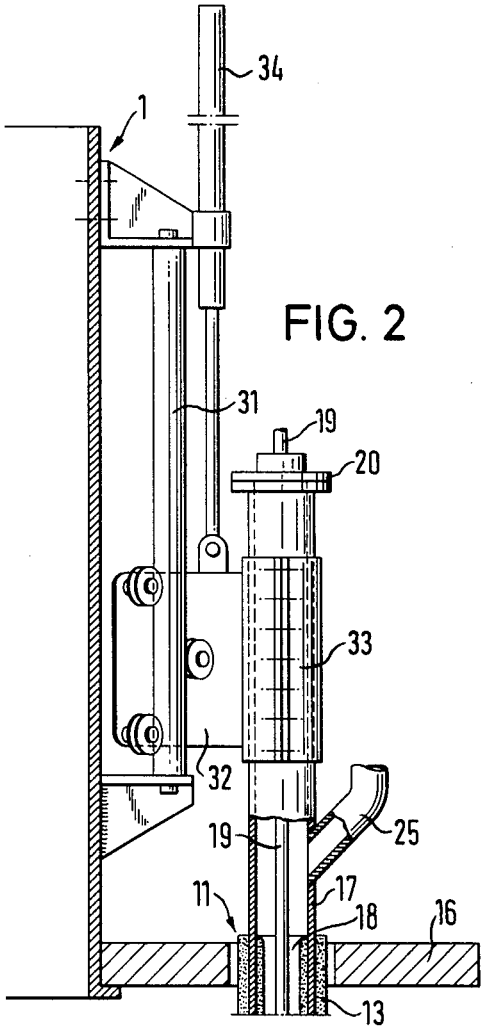
FIGS. 2 and 3 are respectively a diagrammatic side view and a diagrammatic plan view of the lever mechanism for the pipe forming a part of the closure apparatus.
Figure 3:
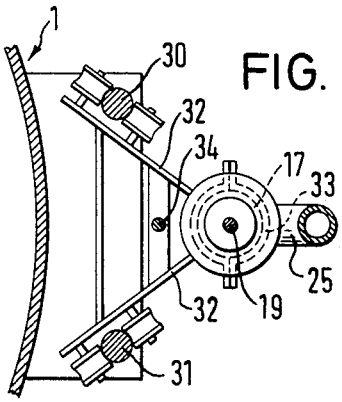

The mechanism for displacing the pipe 11, as shown in side view and plan view in FIGS. 2 and 3, includes two perpendicular columns or pillars 30 and 31 which are mounted to the outside wall of the vessel and which serve as guide rails for a carriage 32. The pipe 11 is clamped in the carriage 32 by means of a sleeve 33. The carriage 32 can be moved up and down along the pillars 30 and 31 by means of a linear drive 34. The stroke movement of the carriage 32 is determined by the requirement that the pipe 11 can be displaced from the blocking position shown in FIG. 1 into a raised open position in which the pipe is entirely withdrawn out of the molten metal and a layer of slag floating thereon. The level to which the pipe 11 can be withdrawn is determined by the highest possible level of the bath in the vessel, which of course must be below the underside of the cover member 16.

The mode of operation of the above-described apparatus will now be described, more particularly when it is used in a smelting furnace:

Before the furnace is put into operation, the tap hole 4 is closed off from below by the shut-off member 6, and a predetermined amount of fine-grain refractory material is introduced into the tap hole by means of the pipe 11, in the lowered position shown in FIG. 1. The filling material should fill up the entire tap hole 4. After the pipe 11 has been lifted to a height at which the lower discharge opening 15 is disposed approximately in the region of the underside of the cover member 16, the operation of charging the furnace vessel and smelting the charge material in the usual manner for the type of furnace in question is begun. The molten bath which is formed covers the tap hole 4 and causes the filling material 7 in the tap hole 4 to be partially sintered. When the molten bath covered by a layer of slag has reached the desired composition and tapping temperature, the tapping operation is begun by moving the lower shut-off member into the open position, that is to say, in the embodiment illustrated in FIG. 1, by pivoting the plate which bears against the tap hole 4 from below, about the axis 8, by means of a suitable actuating arrangement. Generally, the filling material drops out or is urged out by the hydrostatic pressure, and the liquid metal flows out of the vessel in the form of a jet. If the discharge flow of metal out of the vessel is impeded by sintered bridges which have been formed in the tap hole, then the lance is lowered to the tap hole 4, with oxygen being introduced therethrough, and the tap hole is thus burnt free. In that operation, the pipe 11 remains in the raised position, above the surface of the slag. After the tap hole 4 has been burnt free, the lower portion of the lance which had come into contact with the molten bath and the slag, is burnt away by the oxygen introduced and the remaining portion of the lance is retracted upwardly again into the pipe 11.

If the vessel is to be operated in accordance with the 'sump mode of operation', wherein a part of the liquid metal, for example 50% thereof, is to be held back in the furnace vessel for the next smelting process, then the flow of liquid metal to the tap hole 4 is stopped by lowering the pipe 11 into the position shown in FIG. 1. When that is done, the lance is held in the illustrated relative position with respect to the pipe 11, and carbon dioxide gas or nitrogen gas is injected through the lance during the downward movement of the pipe 11. On the one hand, the injected gas keeps the bottom discharge opening 15 of the pipe 11 open when the pipe 11 dips into the layer of slag 10 and into the molten bath 9, while on the other hand the injected gas also cools the pipe. After the flow of liquid metal 9 to the tap opening 4 has been stopped, the feed of gas to the lance 19 can be switched over to oxygen again and, if necessary, the tap hole 4 can be freed of any particles of metal clinging thereto, by briefly injecting oxygen, after the lance 19 has been lowered. Thereafter, the tap hole is closed again from below by the shut-off member 6, and, after the lance 19 has been raised within the lowered pipe 11 into the position shown in FIG. 1, a predetermined amount of fine-grain refractory material which had been introduced into the hopper 26 flows through the annular passage 18. The granular material then flows through the lower discharge opening 15 of the pipe 11 and into the tap hole 4 and serves as the filling material for the next smelting process. Finally, the pipe 11 is raised to its upper position, with a gas being introduced, and then, after the next charge has been introduced into the furnace vessel, the next smelting process can be begun.

It will be seen from the foregoing description that the closure apparatus makes it possible for the residual molten material required when carrying out a 'sump mode of operation' to be allowed to remain in the vessel without the vessel having to be tilted. The same applies in regard to holding back the slag which floats on the metal bath. In addition, the closure apparatus can be arranged to perform further functions such as burning free the tap hole and introducing a filling material into the tap hole, for which separate pieces of equipment are otherwise required. The described and illustrated lance 19 may also be formed by a plurality of concentric pipes so that various gases can be injected at the same time and the lance or the pipe can also be used as a burner in order additionally to heat the molten bath in the region of the part of the metallurgical vessel which projects outwardly in a bay window-like configuration. In addition, a gas may also be injected by way of the opening 35. That gas may be an inert gas or a cooling gas in order to cool the pipe and to keep the lower discharge opening 15 thereof free when the pipe 11 is moved downwardly, as it dips into the layer of slag 10 and into the molten bath 9. The gas may also be a combustible gas so that the pipe can be operated as a burner, in conjunction with the lance 19 which is axially displaceable within the pipe and which provides the feed of oxygen.

We claim:

1. A closure apparatus for a tap hole in a bottom of a metal smelting furnace in which during operation of the furnace: a minimum level and a maximum permissible level of molten metal bath and slag are maintained and a filling material capable of flow is in said tap hole, comprising: a shut-off member for closing off the tap hole from below the bottom, a pipe which is displaceable from a lowered blocking position in which the pipe bears against an upper edge of the tap hole below the minimum level, into a raised position in which the pipe opens the tap hole and is located above the maximum permissible level, said pipe having a protective layer of refractory material at least in a region thereof which contacts the molten metal bath and slag in the furnace, said pipe also having an upper material opening for introducing the filling material through the pipe into the tap hole to protect the shut-off member from direct contact with the molten metal bath.

2. A closure apparatus according to claim 1, wherein the pipe includes a metal pipe which is provided with a protective layer of refractory material on the outside thereof, at least in the region which dips into the furnace, as well as at the lower end thereof and on the inside thereof.

3. A closure apparatus according to claim 1, wherein the pipe includes at least one upper gas intake opening for introducing a gas.

4. A closure apparatus according to claim 1, wherein the pipe includes cooling passages through which a coolant flows.

5. A closure apparatus according to claim 1, wherein the pipe is formed as a burner.

6. A closure apparatus according to claim 1, wherein a lance for introducing a gas is axially displaceably disposed within the pipe, thereby forming an annular passage.

7. A closure apparatus according to claim 6, wherein the upper material opening for introducing the filling material opens into the annular passage.

8. A closure apparatus according to claim 6, wherein in an upper portion the pipe includes a closure cover member having an opening provided with a seal, for the lance to pass therethrough.

9. A closure apparatus according to claim 6, wherein the lance comprises at least two concentric metal pipes which form a central passage, and at least one annular passage, and wherein the central passage has an upper end connected to a source of oxygen-bearing gas, and wherein at a repsective upper end at least one of the annular passage is connected to a source of a gaseous fuel.

10. A closure apparatus according to claim 3, wherein an upper lateral open is provided in the pipe for introducing a gas.

11. A closure apparatus according to claim 1, wherein the tap hole is formed by a tubular tap means of refractory apertured bricks, which is fitted into the bottom of the furnace.

12. A closure apparatus according to claim 1, disposed in a part of the furnace which projects in the manner of a bay window.

* * * * *